US007227090B2

(12) United States Patent
Kakuno et al.

(10) Patent No.: US 7,227,090 B2
(45) Date of Patent: Jun. 5, 2007

(54) SWITCHING APPARATUS

(75) Inventors: Hideyo Kakuno, Tajimi (JP); Katsuya Koyama, Aisai (JP); Shinichi Togawa, Kasugai (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 11/387,103

(22) Filed: Mar. 22, 2006

(65) Prior Publication Data

US 2007/0062788 A1 Mar. 22, 2007

(30) Foreign Application Priority Data

Sep. 20, 2005 (JP) ..... 2005-272896

(51) Int. Cl.
*H01H 9/00* (2006.01)

(52) U.S. Cl. ..... 200/6 A; 200/5 A; 200/329; 345/157; 345/160

(58) Field of Classification Search ..... 200/6 A, 200/6 R, 5 A, 5 R, 329, 18, 17 R, 11 TW, 200/11 R, 14; 345/157–161, 165–167
See application file for complete search history.

(56) References Cited

U.S. PATENT DOCUMENTS 4,284,865 A * 8/1981 Nicholson ..... 200/332.2
6,069,327 A 5/2000 Ushimaru
6,255,610 B1 * 7/2001 Botz et al. ..... 200/315

(Continued)

FOREIGN PATENT DOCUMENTS

EP 1416506 A2 5/2004

(Continued)

OTHER PUBLICATIONS

European Search Report For European Application No. 06004652 mailed Dec. 28, 2006 (5 pages).

*Primary Examiner*—Kyung Lee
*Assistant Examiner*—Richard K. Lee
(74) *Attorney, Agent, or Firm*—Osha-Liang LLP

(57) ABSTRACT

A switching apparatus includes a case, an operation shaft whose one end outwardly projects from inside of the case and which is provided at its central portion with a flange, a support member which supports the flange such that the operation shaft can rock and rotate, an operation knob mounted on one end of the operation shaft, a first contact which is switched when the operation knob is pushed to move the operation shaft, a second contact which is switched when the operation knob is rotated to rotate the operation shaft, and a third contact which is switched when the operation knob is rocked to rock the operation shaft. The support member comprises a first support member which supports the flange from the operation knob in a state where the operation shaft penetrates the first support member, and a second support member which is disposed inside of the first support member and which supports the flange from the opposite side from the operation knob in a state where the operation shaft penetrates the second support member. The first contact is disposed in the vicinity of the operation shaft on the opposite side from the operation knob of the support member adjacent to the second support member, and the first contact is switched by the second support member which follows the operation shaft and moves when the operation knob is pushed.

8 Claims, 13 Drawing Sheets

U.S. PATENT DOCUMENTS

| | | | | |
|---|---|---|---|---|
| 6,369,692 | B1 * | 4/2002 | Van Zeeland | 338/200 |
| 6,852,938 | B2 * | 2/2005 | Nakade | 200/200 |
| 6,884,948 | B2 | 4/2005 | Gotoh | |
| 6,948,824 | B2 | 9/2005 | Miwa | |

FOREIGN PATENT DOCUMENTS

| | | |
|---|---|---|
| JP | 3033205 | 2/2000 |
| JP | 2001-291456 | 10/2001 |

* cited by examiner

SWITCHING APPARATUS

BACKGROUND OF THE INVENTION

1. Field of the Invention

The present invention relates to switching apparatus having an operation knob which can be pushed, rotated and rocked.

2. Description of the Relates Art

A switching apparatus used for a power mirror apparatus is disposed on an arm rest or a front panel of a driver's seat of an automobile. The power mirror apparatus electrically adjusts visual angles of left and right side mirrors and tilts the side mirror up and down. It is required that the switching apparatus can perform switching action for tilting up or down the side mirror (switching action of electric connection state of contact), switching action for selecting one of the left and right side mirrors, and switching action for adjusting visual angle of the selected side mirror.

Some of the conventional switching apparatuses include an operation knob operated for switching a contact for tilting up/down the side mirror, an operation knob operated for switching a selection contact of the side mirror, and an operation knob operated for switching an adjustment contact of the visual angle of the side mirror.

Further, as disclosed in Japanese Patent Application Laid-Open No. 2005-44582 and Japanese Patent Application Laid-Open No. 2004-134239, there is a switching apparatus having one operation knob which is rotated for switching the selecting contact of the side mirror and which is rocked for switching the adjustment contact of the visual angle of the side mirror. The switching apparatus disclosed in Japanese Patent Application Laid-Open No. 2005-44582 and Japanese Patent Application Laid-Open No. 2004-134239 has a structure for providing the rotation operation and the rocking operation of the operation knob with a click feeling (operating feeling).

Further, as disclosed in Japanese Patent Application Laid-Open No. 2001-291456, there is a switching apparatus having one operation knob which is pushed for switching the contact for tilting up/down the side mirror, and which is rotated for switching the selection contact of the side mirror, and which is rocked for switching the adjustment contact of the visual angle of the side mirror. The switching apparatus disclosed in Japanese Patent Application Laid-Open No. 2001-291456 has a structure for providing the rotation operation and the rocking operation of the operation knob with a click feeling.

Further, Japanese Patent No. 3033205 discloses a switching apparatus (joystick apparatus) for a vehicular audio set. This switching apparatus has one operation rod which is pushed, rotated and rocked for switching contacts corresponding to a plurality of functions of the audio set. The switching apparatus disclosed in Japanese Patent No. 3033205 has a structure for providing the rotation operation and the rocking operation of the operation rod with a click feeling.

According to the conventional switching apparatuses having the plurality of operation knobs, however, it is necessary to re-hold the operation knob which is to be operated according to the need and thus, it is troublesome to operate, and the operability is poor. In the switching apparatuses of Japanese Patent Application Laid-Open No. 2005-44582 and Japanese Patent Application Laid-Open No. 2004-134239, the pushing operation of the operation knob is not taken into consideration, and the contact which is switched over by pushing the operation knob is not provided. In the switching apparatus of Japanese Patent Application Laid-Open No. 2001-291456, the operation shaft connected to the operation knob is supported by one holder, two sliders and two springs. Therefore, the number of parts is high and the structure is complicated. Further, since a contact which is switched by pushing the operation knob is provided outside of the support members, the switching apparatus can not be reduced in size. In the switching apparatus of Japanese Patent No. 3033205, an internal structure of a switch unit which is switched by pushing and rotating the operation shaft is not disclosed in detail.

The present invention has been accomplished to solve the above problem, and it is an object of the invention to provide a switching apparatus which has excellent operability and simple structure and which realizes different switching actions depending upon pushing, rotating and rocking operations of one operation knob.

SUMMARY OF THE INVENTION

A switching apparatus comprising a case, an operation shaft whose one end outwardly projects from inside of the case and which is provided at its central portion with a flange, a support member which supports the flange such that the operation shaft can rock and rotate, an operation knob mounted on one end of the operation shaft, a first contact which is switched when the operation knob is pushed to move the operation shaft, a second contact which is switched when the operation knob is rotated to rotate the operation shaft, and a third contact which is switched when the operation knob is rocked to rock the operation shaft, wherein the support member comprises a first support member which supports the flange from the operation knob in a state where the operation shaft penetrates the first support member, and a second support member which is disposed inside of the first support member and which supports the flange from the opposite side from the operation knob in a state where the operation shaft penetrates the second support member, the first contact is disposed in the vicinity of the operation shaft on the opposite side from the operation knob of the support member adjacent to the second support member, and the first contact is switched by the second support member which follows the operation shaft and moves when the operation knob is pushed.

With this structure, the first contact is switched by pushing the operation knob, the second contact is switched by rotating the operation knob, and the third contact is switched by rocking the operation knob. Therefore, it is possible to realize different switching actions by pushing, rotating and rocking the one operation knob, and as compared with the conventional switching apparatus provided with a plurality of operation knobs which are operated differently, the operability can remarkably be enhanced. Further, since the two support members support the operation shaft, the number or parts is smaller and the structure can be more simplified than the switching apparatus disclosed in Japanese Patent Application Laid-Open No. 2001-291456. The second support member is disposed inside of the first support member, the first contact is provided in the vicinity of the operation shaft on the opposite side from the operation knob of the second support member, and the first contact is switched by the second support member. Therefore, as compared with the switching apparatus disclosed in Japanese Patent Application Laid-Open No. 2001-291456, spaces in the case occupied by the support member and the first contact can be reduced, and the switching apparatus can be reduced in size.

In an embodiment of the invention, a notch is provided in the first support member on the opposite side from the operation knob, and the first contact is disposed in the notch.

With this structure, the first support member can be disposed in the vicinity of the second support member and the operation shaft, and the switching apparatus can further be reduced in size without affecting the first contact.

According to an embodiment of the invention, when the operation knob rotates, the first support member follows the operation shaft and rotates, a guide member is provided in the vicinity of an outer side of the first support member, the guide member engages with the first support member under predetermined pressure for guiding rotation of the first support member, a recess and a convex portion are provided in parallel to each other on the guide member in the rotation direction.

With this structure, if the first support member engages the recess and the convex portion of the guide member when the operation knob is rotated, it is possible to provide the click feeling, and the operability can further be enhanced. Since the number of parts required for providing the click feeling for the rotation operation is small, the structure of the switching apparatus 100 can be simplified. Since the guide member is disposed in the vicinity of the outer side of the first support member, the space in the case occupied by the guide member can be reduced, the first contact can be disposed closer to the operation shaft than the guide member without being hindered by a member which gives the click feeling for the rotation operation, and the switching apparatus can further be reduced in size.

According to an embodiment of the invention, the first contact is provided in a push switch having an actuator which can be pushed, the actuator is switched if the actuator is pushed by the second support member.

With this structure, the first contact can be disposed easily, the number of parts required for switching the first contact is small, and the structure can further be simplified as compared with the switching apparatus disclosed in Japanese Patent Application Laid-Open No. 2001-291456 in which the fixed contact and the movable contact which are switched by pushing the operation knob are provided on different members.

According to the present invention, the first, second and third contacts are switched over by pushing, rotating and rocking the operation knob. Therefore, it is possible to realize different switching actions depending upon pushing, rotating and rocking operations of the one operation knob, and the operability can be enhanced. Further, the operation shaft is supported by the two support members, and the second support member is disposed inside of the first support member, the first contact is provided in the vicinity of the operation shaft on the opposite side from the operation knob of the second support member, and the first contact is switched by the second support member. Therefore, the structure is simple and the apparatus can be made small.

DETAILED DESCRIPTION OF THE PREFERRED EMBODIMENTS

Figure 1:
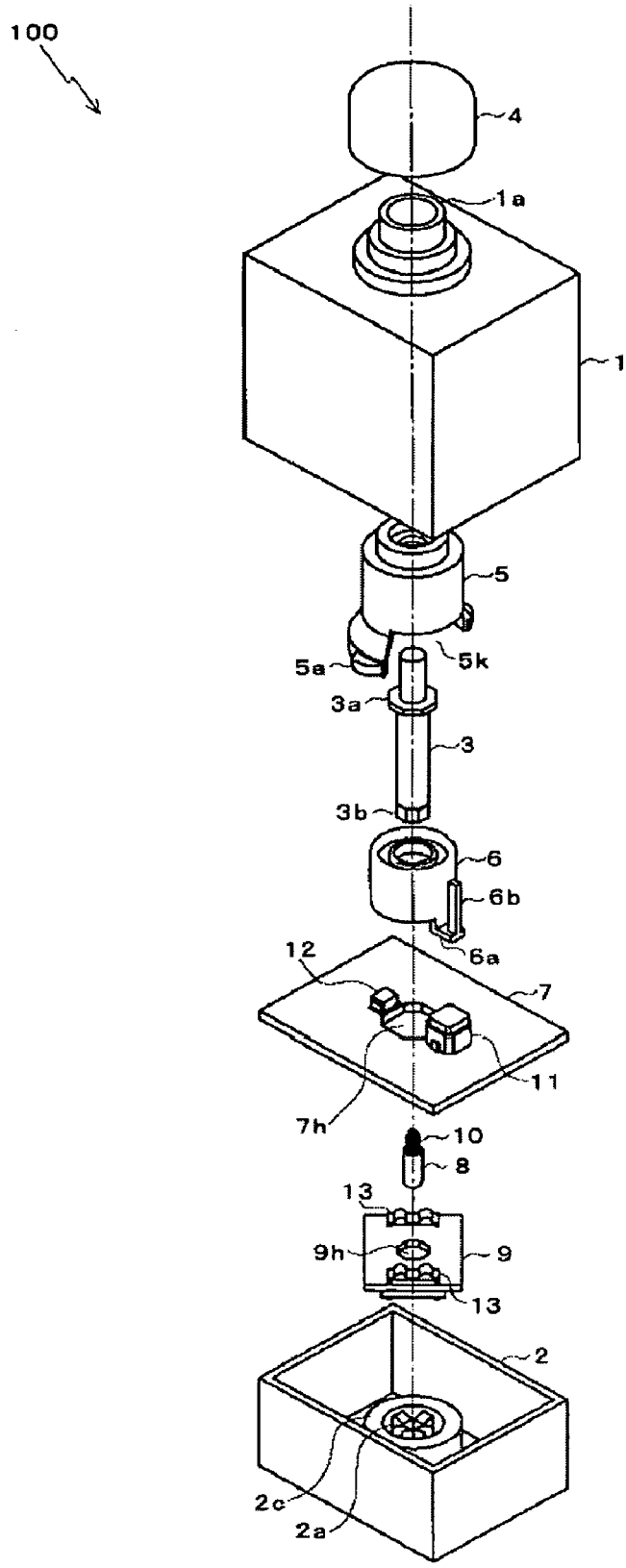
FIG. 1 shows an exploded perspective view of a switching apparatus according to an embodiment of the present invention.

FIG. 1 is an exploded perspective view of a switching apparatus 100 according to an embodiment of the present invention. The switching apparatus 100 is used for a power mirror apparatus which electrically adjust a visual angle of vehicular left and right side mirrors, and tilts up and down the side mirrors. As shown in FIG. 1, the switching apparatus 100 mainly comprises a case 1, a cover 2, an operation shaft 3, an operation knob 4, an outer striker 5, an inner striker 6, a substrate 7, a plunger 8 and a slider 9.

Figure 2:
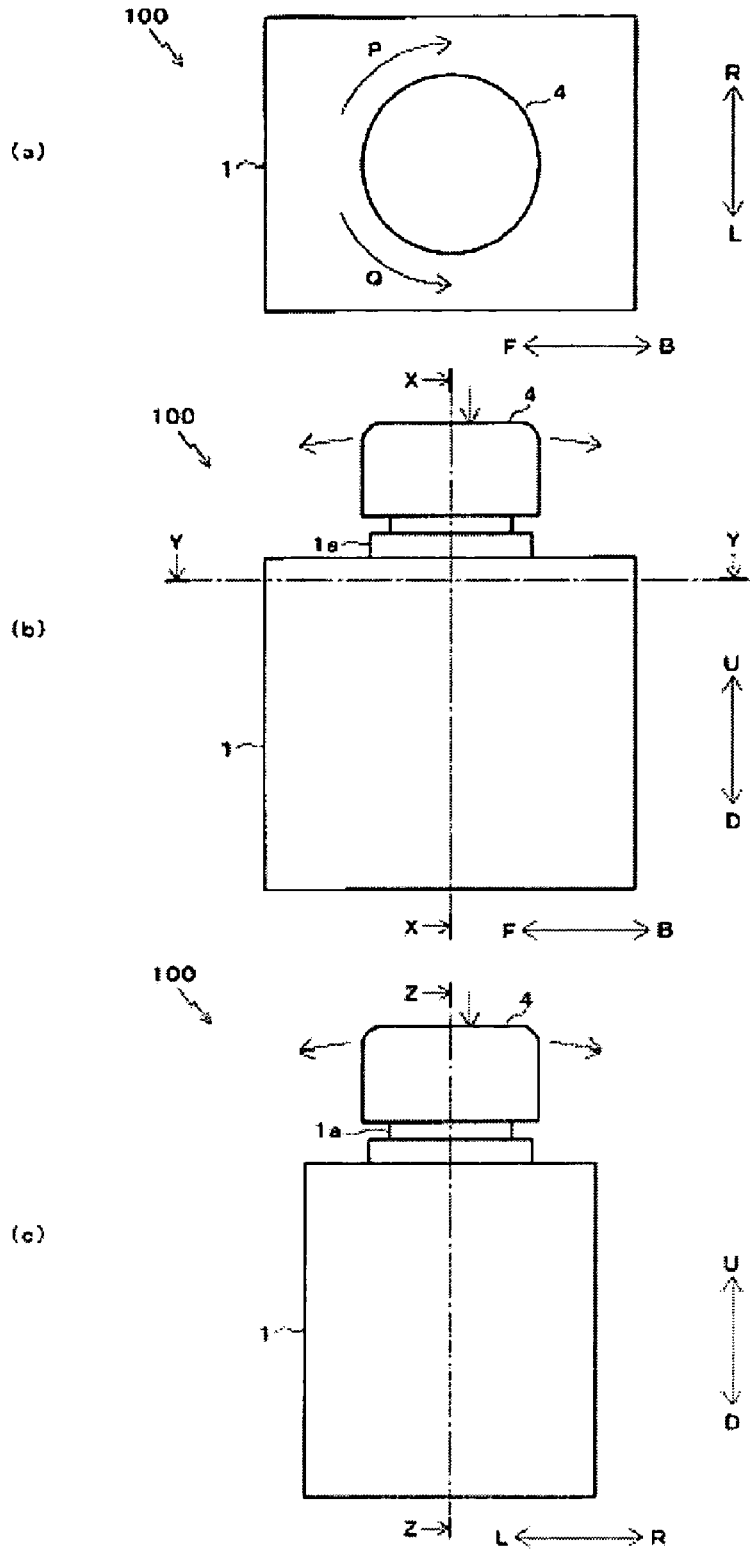
FIGS. 2A, B, and C show an outward appearance view of the switching apparatus.
Figure 3:
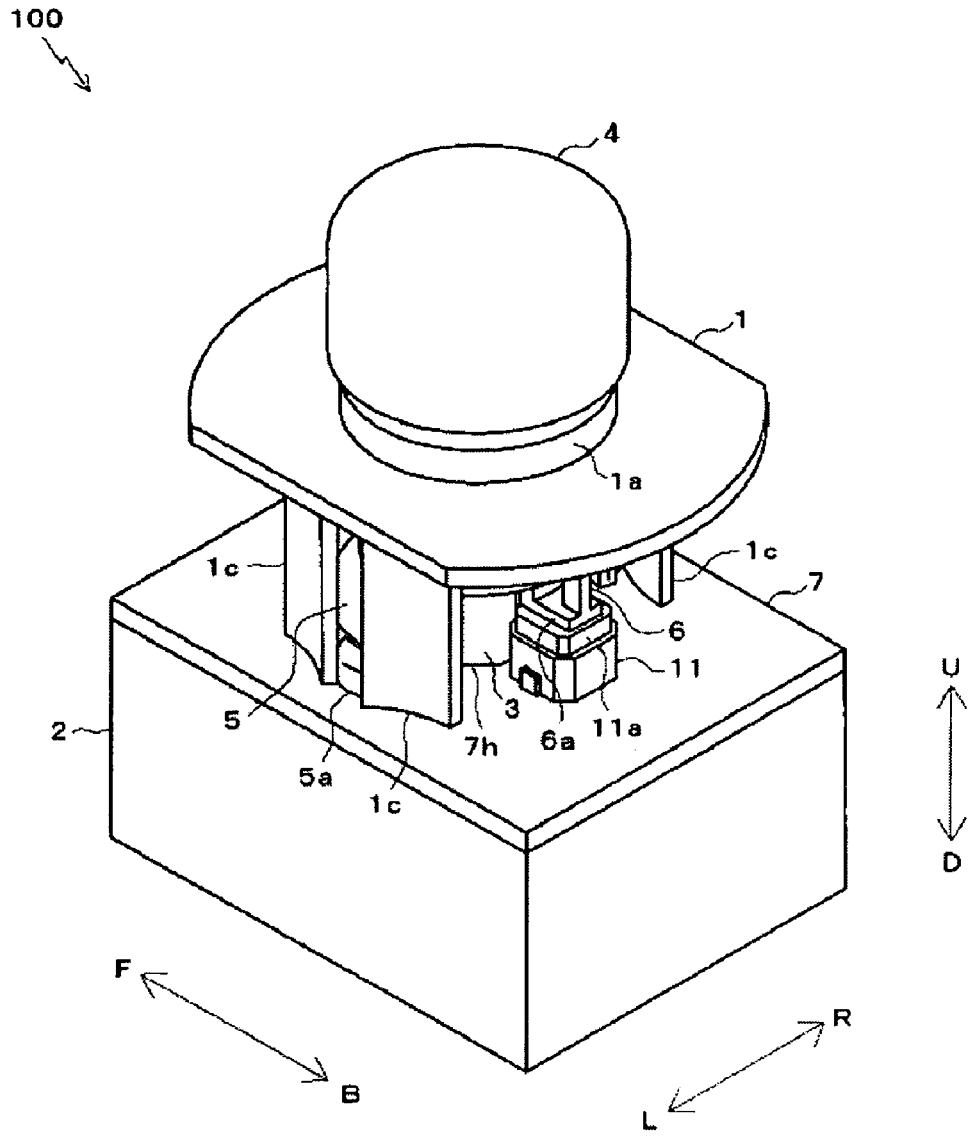
FIG. 3 shows a perspective view of the switching apparatus.
Figure 4A:
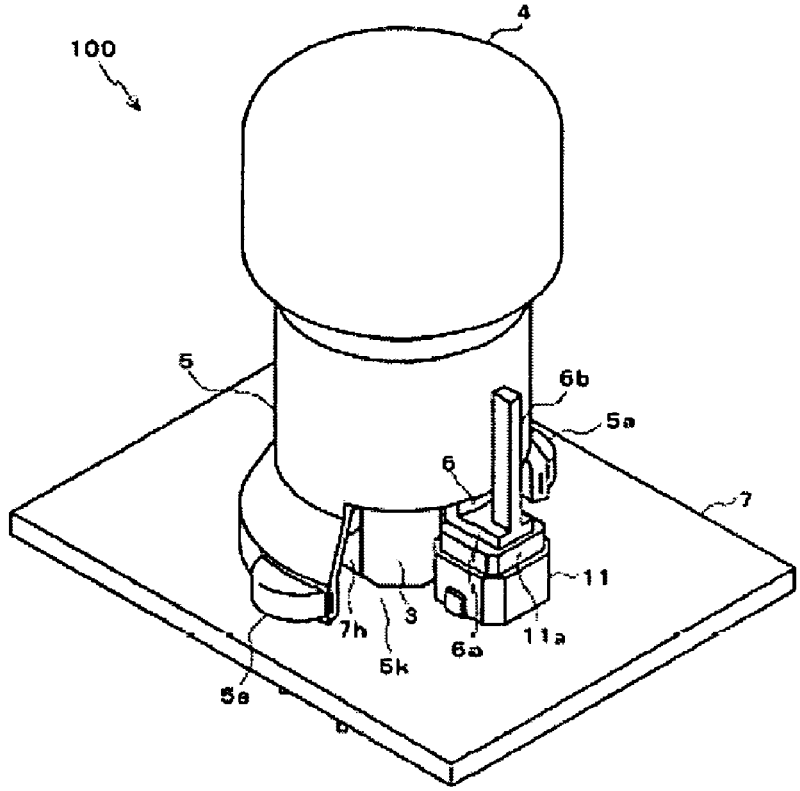
FIGS. 4A and B show a perspective view of the switching apparatus.
Figure 4B:
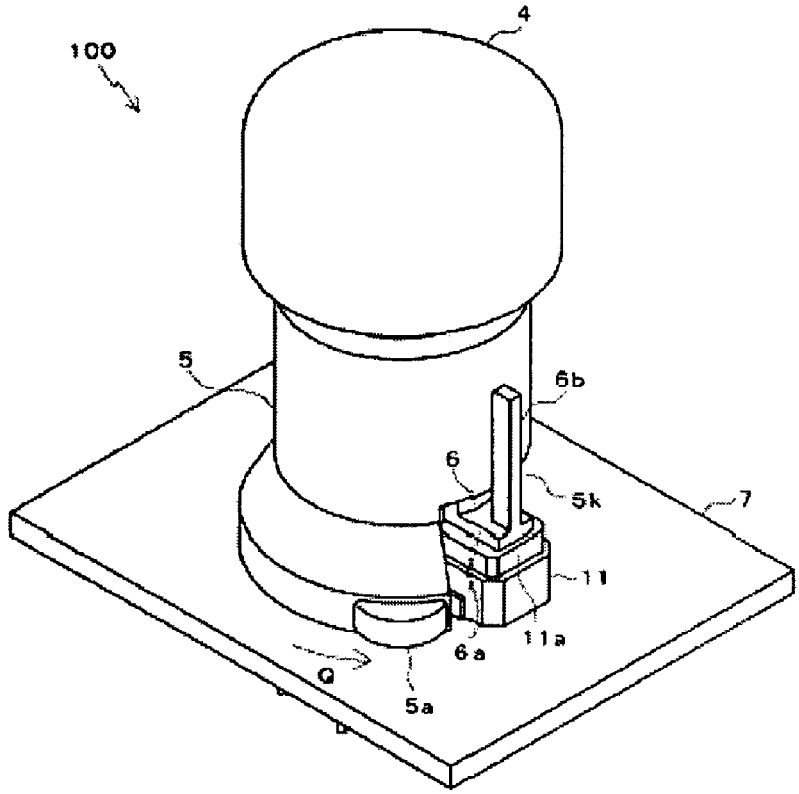
Figure 5:
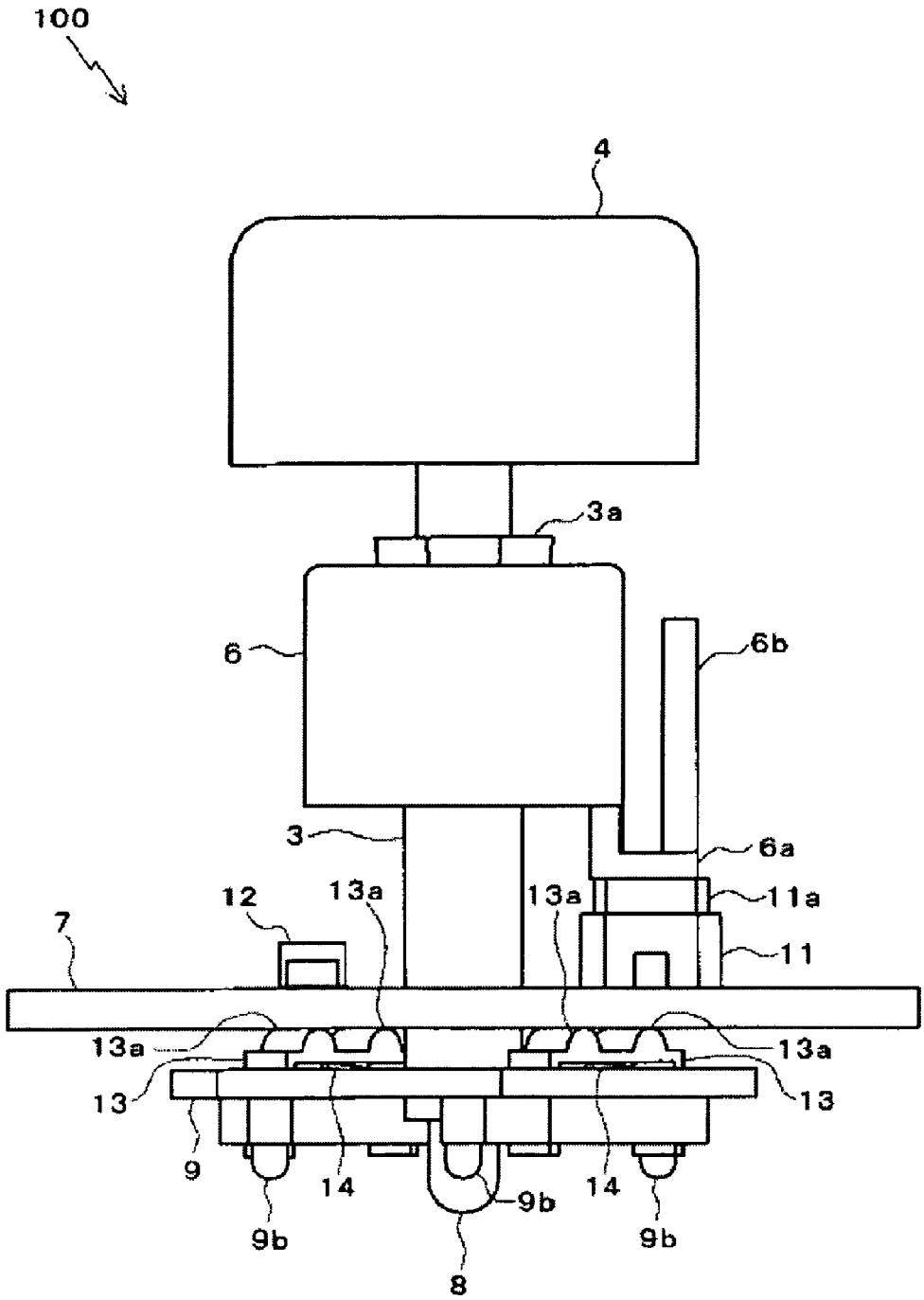
FIG. 5 shows a side view of the switching apparatus.
Figure 6A:
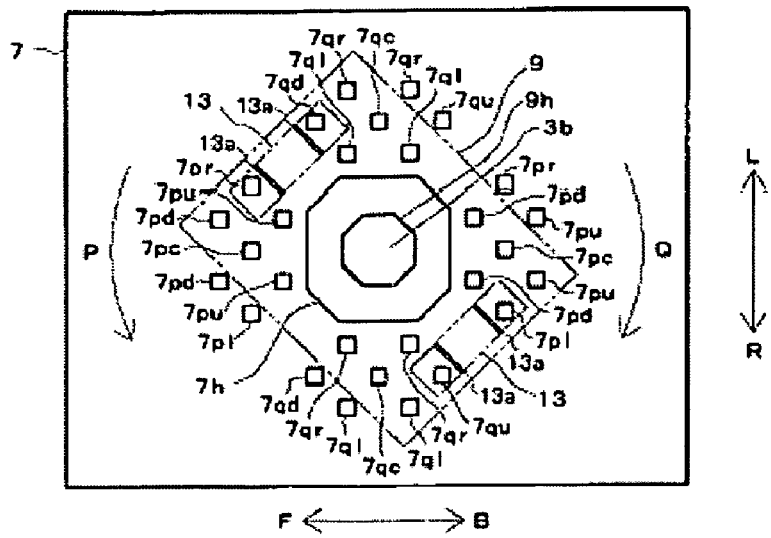
FIGS. 6A, B, and C show a substrate and a slider of the switching apparatus.
Figure 8A:
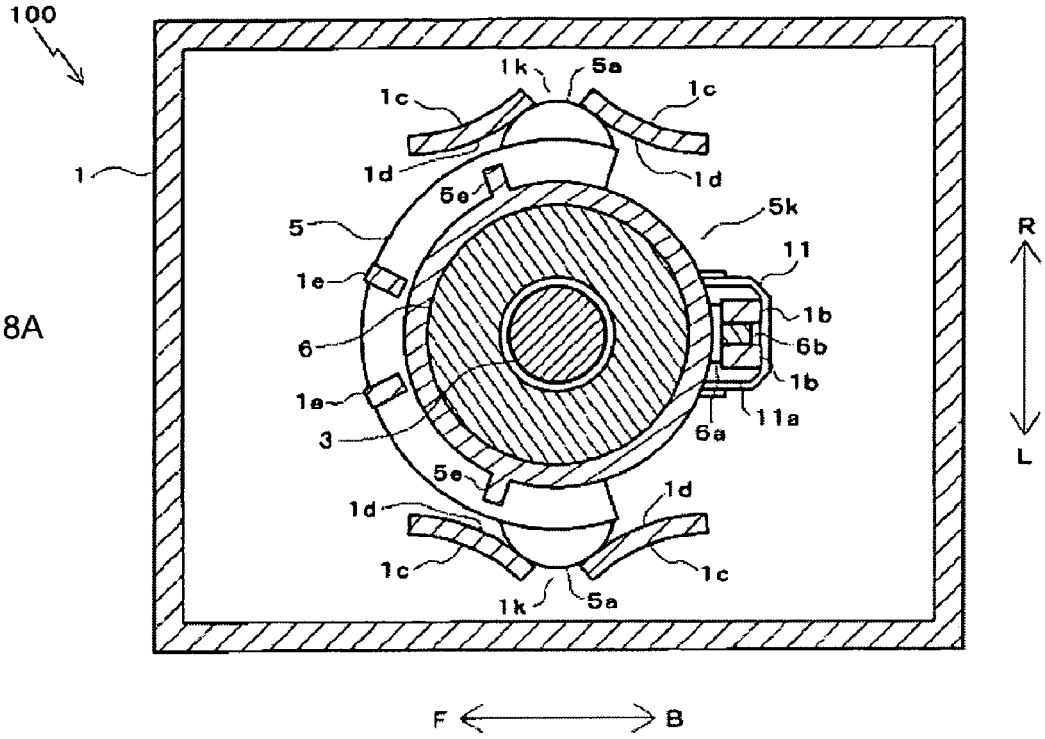
FIGS. 8A and B show a sectional view of the switching apparatus taken along the line Y—Y in FIG. 2.
Figure 8B:
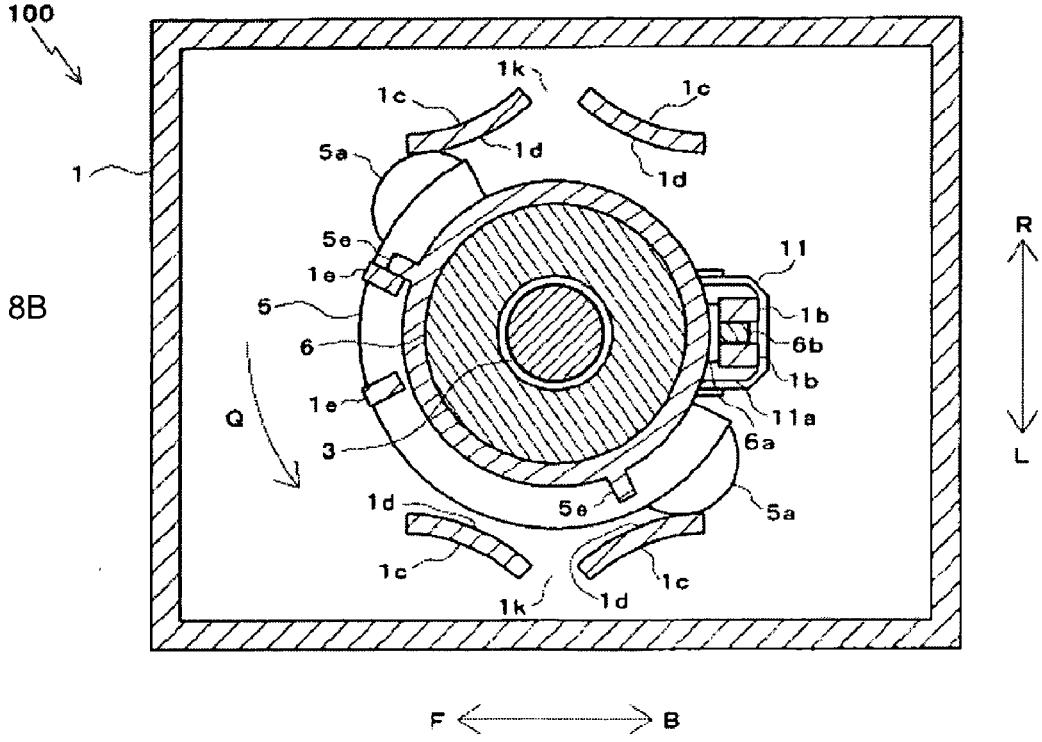
Figure 9:
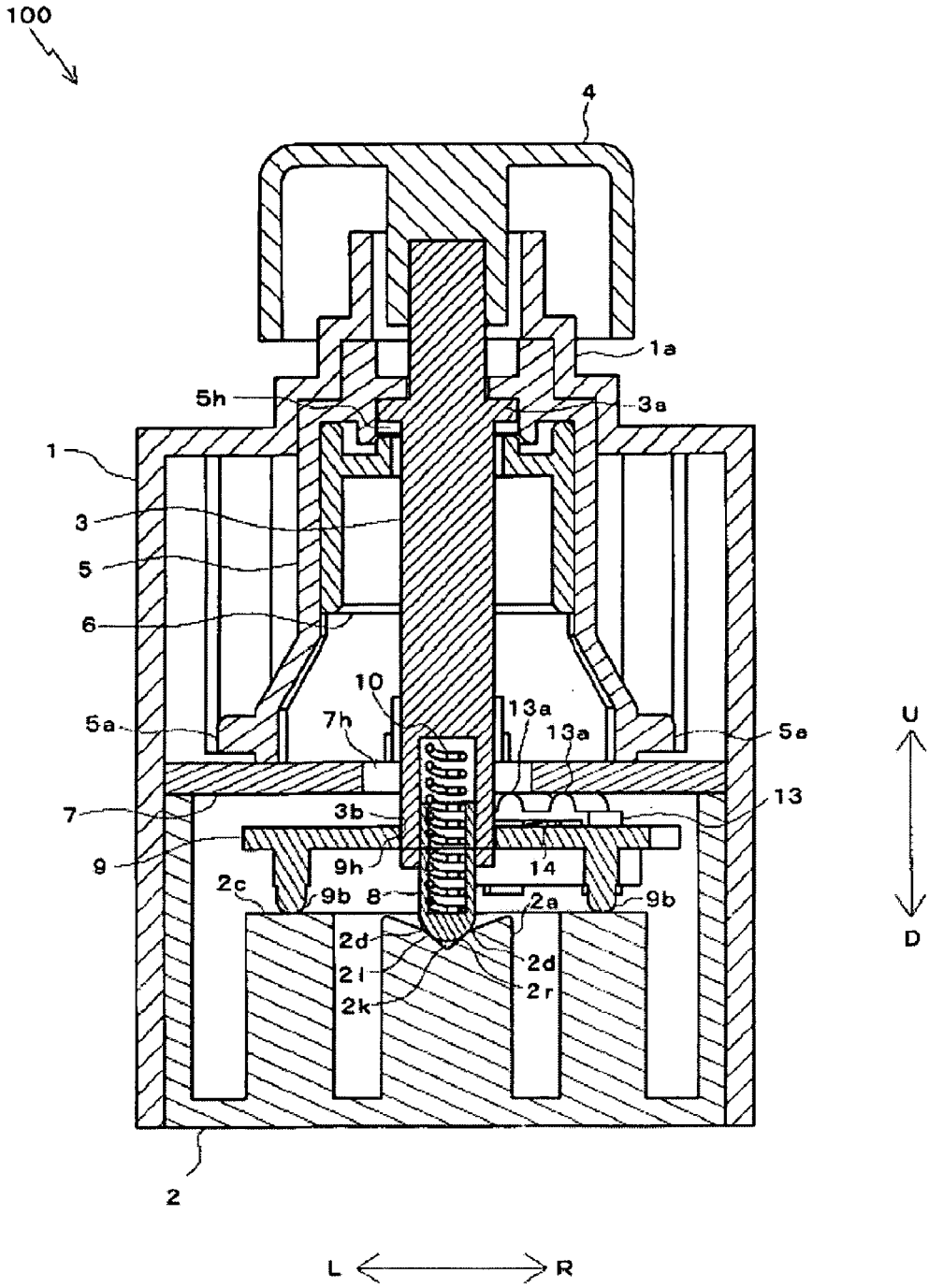
FIG. 9 shows a sectional view of the switching apparatus taken along the line X—X in FIG. 2.
Figure 10:
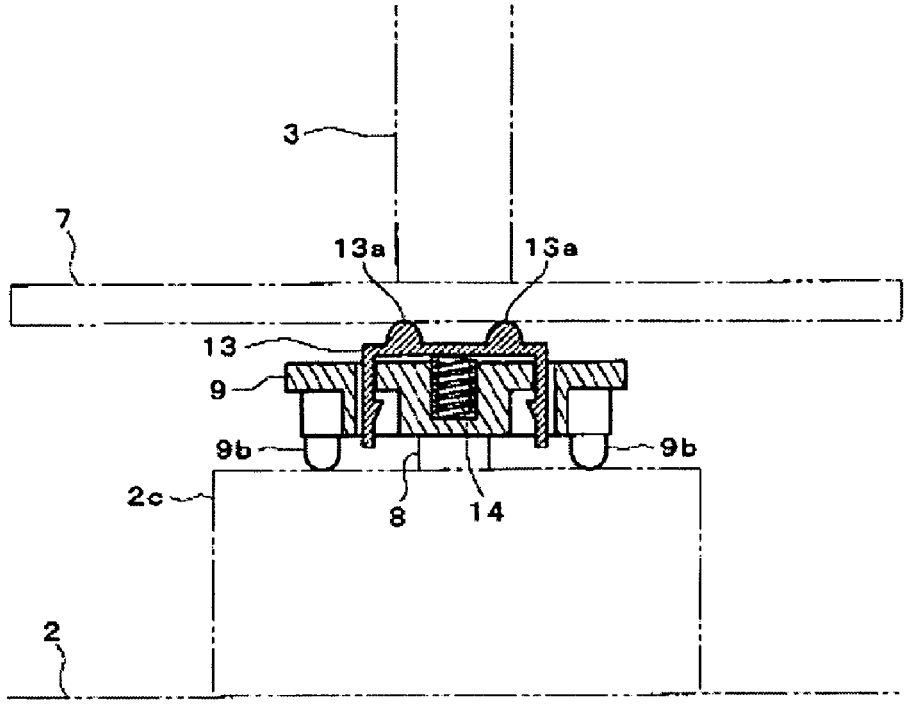
FIG. 10 shows a sectional view of the slider of the switching apparatus.

FIGS. 2 to 10 show an assembled state of the switching apparatus 100. Specifically, FIG. 2 show an outward appearance view of the switching apparatus 100, FIG. 2A shows a plan view, FIG. 2B shows a left side view and FIG. 2C shows a rear side view. FIGS. 3 and 4 are perspective views of the switching apparatus 100. In FIG. 3, a portion of the case 1 is omitted, and in FIG. 4, the case 1 and the cover 2 are omitted. FIG. 5 shows a side view of the switching apparatus 100, and the case 1, the cover 2 and a first striker 5 are omitted. FIG. 6 show the substrate 7 and the slider 9, and show the substrate 7 as viewed from its lower surface. FIGS. 7A to 7D show sectional views of the switching apparatus 100 taken along the line Z—Z in FIG. 2. FIG. 8 show sectional views of the switching apparatus 100 taken along the line Y—Y in FIG. 2. FIG. 9 shows a sectional view of the switching apparatus 100 taken along the line X—X in FIG. 2. FIG. 10 shows a sectional view of the slider 9, and shows a cross section perpendicular to a cross section of FIG. 7B as viewed from left.

Figure 7A:
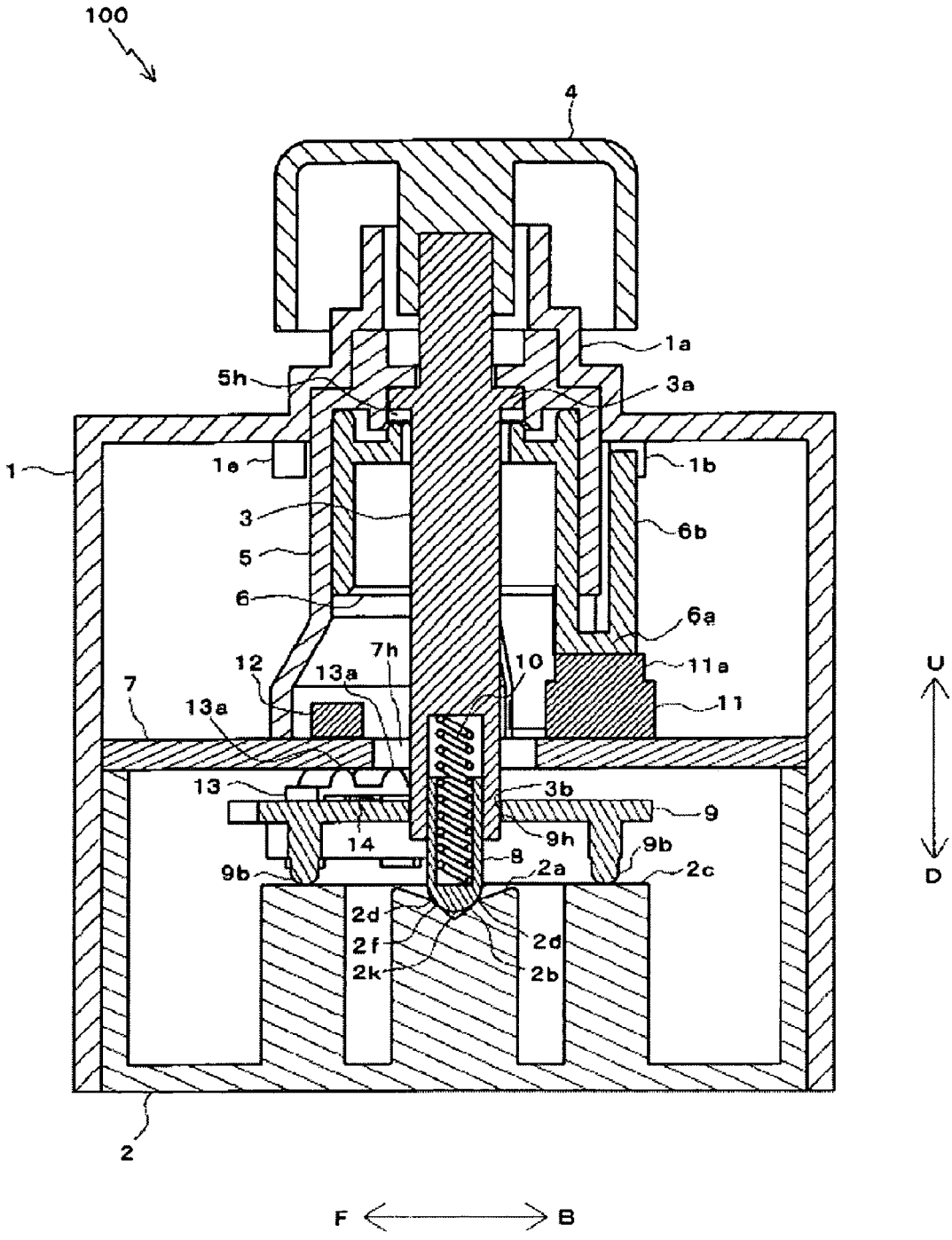
FIG. 7A shows a sectional view of the switching apparatus taken along the line Z—Z in FIG. 2.

As shown in FIG. 7A, a lower portion of the case 1 is opened. The lower portion of the case 1 is closed by fitting a cover 2 thereinto. The case 1 is integrally provided at its upper surface with a cylinder 1*a* which is vertically opened and is in communication with the case 1. Inner and outer diameters of the cylinder 1*a* are reduced toward its upper portion in stages. An operation shaft 3 is provided in the case 1 and the cylinder 1*a*. An upper end of the operation shaft 3 penetrates the cylinder 1*a* from inside of the case 1 and projects outward. The operation knob 4 is mounted on the upper end such as to cover the upper opening of the cylinder 1*a*. In this mounting state, a gap is formed between the operation knob 4 and the cylinder 1*a*. Therefore, the operation knob 4 can be pushed downward D as shown with the thick arrows in FIG. 2, the operation knob 4 can be rotated in the clockwise direction P and the counterclockwise direction Q, and can be rocked forward F, rearward B, rightward R and leftward L. The operation shaft 3 can move in the axial direction (dotted line in FIG. 1) to follow the operation knob 4, rotate around the axial direction and can rock.

The plunger 8 having a semi-spherical tip end as shown in FIG. 7A and the like is mounted on the operation shaft 3 such that the plunger 8 can move in the axial direction of the operation shaft 3. A coil spring 10 is interposed between the operation shaft 3 and the plunger 8. The coil spring 10 adds elastic force acting on the operation shaft 3 and the plunger 8 such that the operation shaft 3 and the plunger 8 are separated from each other in the axial direction. The cover 2 is integrally provided with a guide pedestal 2*a* below the plunger 8. The guide pedestal 2*a* engages with the plunger 8 to guide the movement of a lower end of the operation shaft 3 through the plunger 8 when the operation shaft 3 is rocked. A recess 2*k* is formed in a central portion of an upper portion of the guide pedestal 2*a*. As shown in FIGS. 7A and 9, oblique surfaces 2*f*, 2*b*, 21, 2*r* are provided around the recess 2*k*. The oblique surfaces 2*f*, 2*b*, 21, 2*r* rise into four directions, i.e., forward, backward, leftward and rightward from the recess 2*k* in which the operation knob 4 and the operation shaft 3 can rock. A convex portion 2*d* comprising a step having an obtuse angle is provided on intermediate portions of the oblique surfaces 2*f*, 2*b*, 2*l*, 2*r*. The recess 2*k* and the convex portion 2*d* are provided in parallel in a direction (rocking direction of the operation shaft 3) in which lower ends of the plunger 8 and the operation shaft 3 are guided. The plunger 8 is biased downward by the coil spring 10, and is pushed against the guide pedestal 2*a*. The operation shaft 3 is biased upward by the coil spring 10 and is pushed against the outer striker 5.

The operation shaft 3 is provided at its central portion with a polygonal (octagonal) flange 3*a* as shown in FIG. 1. The operation shaft 3 is inserted into the outer striker 5 from its lower side, and the inner striker 6 is inserted into the outer striker 5 from its lower side such as to penetrate the operation shaft 3. With this, as shown in FIG. 7A and the like, the flange 3*a* of the operation shaft 3 is sandwiched and supported between the outer striker 5 and the inner striker 6. That is, the outer striker 5 supports the upper surface (surface on the side of the operation knob 4) and the side surface of the flange 3*a* as shown in FIGS. 7A to 7C and 9, and the inner striker 6 supports the lower surface (opposite side from the operation knob 4) of the flange 3*a* as shown in FIG. 7D. In this supporting state, a gap is formed between the operation shaft 3 and the strikers 5 and 6. Therefore, the operation shaft 3 can follow the operation knob 4 and rock and rotate. A space 5*h* of the outer striker 5 accommodating the flange 3*a* has the same shape and substantially the same size as the flange 3*a* and is formed into polygonal (octagonal) shape. Therefore, the outer striker 5 can follow the operation shaft 3 and rotate. A lower end of the inner striker 6 is provided with a pressing portion 6*a* which projects such as to penetrate a notch 5*k* provided in a lower end of the outer striker 5 (opposite side from the operation knob 4) as shown in FIGS. 1, 4 and 8. An extending portion 6*b* extending upward is provided on the pressing portion 6*a* at a predetermined distance from the outer striker 5. As shown in FIG. 8, an upper end of the extending portion 6*b* is fitted and held between two stoppers 1*b* which are integrally provided on the case 1. Therefore, the inner striker 6 can not rotate. The striker 5 constitutes an embodiment of a first support member of the present invention, and the striker 6 constitutes an embodiment of a second support member of the invention.

A step-wise outer surface (an upper end surface, a step-wise surface and an outer peripheral surface) continuously extending from a central portion toward an upper end of the outer striker 5 is engaged with a step-wise inner surface (a step-wise surface and an inner peripheral surface) continuously extending from a central portion of an inner side toward a lower end of the cylinder 1*a*. A lower end of the outer striker 5 is supported by the substrate 7. A side surface and a lower surface of the substrate 7 are supported by the case 1 and the cover 2. Thus, the outer striker 5 can not follow the operation shaft 3 and can not move vertically and laterally. The substrate 7 can not rotate, and can not vertically and laterally move. The operation shaft 3 penetrate a hole 7*h* formed in a central portion of the substrate 7. A diameter of the hole 7*h* is greater than that of the operation shaft 3 by a certain value and thus, the operation shaft 3 can move in the axial direction independently from the substrate 7, and can rotate and rock.

As shown in FIGS. 3 to 5 and 7A and the like, the pressing portion 6*a* of the inner striker 6 is placed on and supported by an actuator 11*a* of a push switch (surface mounting type tact switch) 11 mounted on an upper surface of the substrate 7. The push switch 11 is disposed in the vicinity of the operation shaft 3 below the inner striker 6 (opposite side from the operation knob 4) and in the notch 5*k* of the outer striker 5 in the vicinity of the inner striker 6. Since the actuator 11*a* can be pushed into the push switch 11, the inner striker 6 can vertically move. The push switch 11 is provided therein with a known mechanism comprising a spring which biases the 11*a* from inside such as to project the same and which provides click feeling (operation feeling) when the actuator 11*a* is pushed in, or with a contact which is switched from OFF state (open, non-conductive state) to ON state (connect, conductive state) if the actuator 11*a* is pushed in. If the inner striker 6 follows the operation shaft 3 and moves downward, the actuator 11*a* of the push switch 11 is pushed by the pressing portion 6*a* of the inner striker 6, the inner contact of the push switch 11 is switched from the OFF state to the ON state. The inner contact of the push switch 11 outputs a command signal for tilting the side mirror up or down to a control unit (not shown) which control the operation of the side mirror. The inner contact constitutes an embodiment of a first contact in the invention.

On the upper surface of the substrate 7, an electronic component such as a light-emitting diode 12 is mounted in addition to the push switch 11. An electric circuit comprising the electronic component and wire pattern (not shown) is formed. The light-emitting diode 12 emits light to the operation knob 4 from below.

Figure 7B:
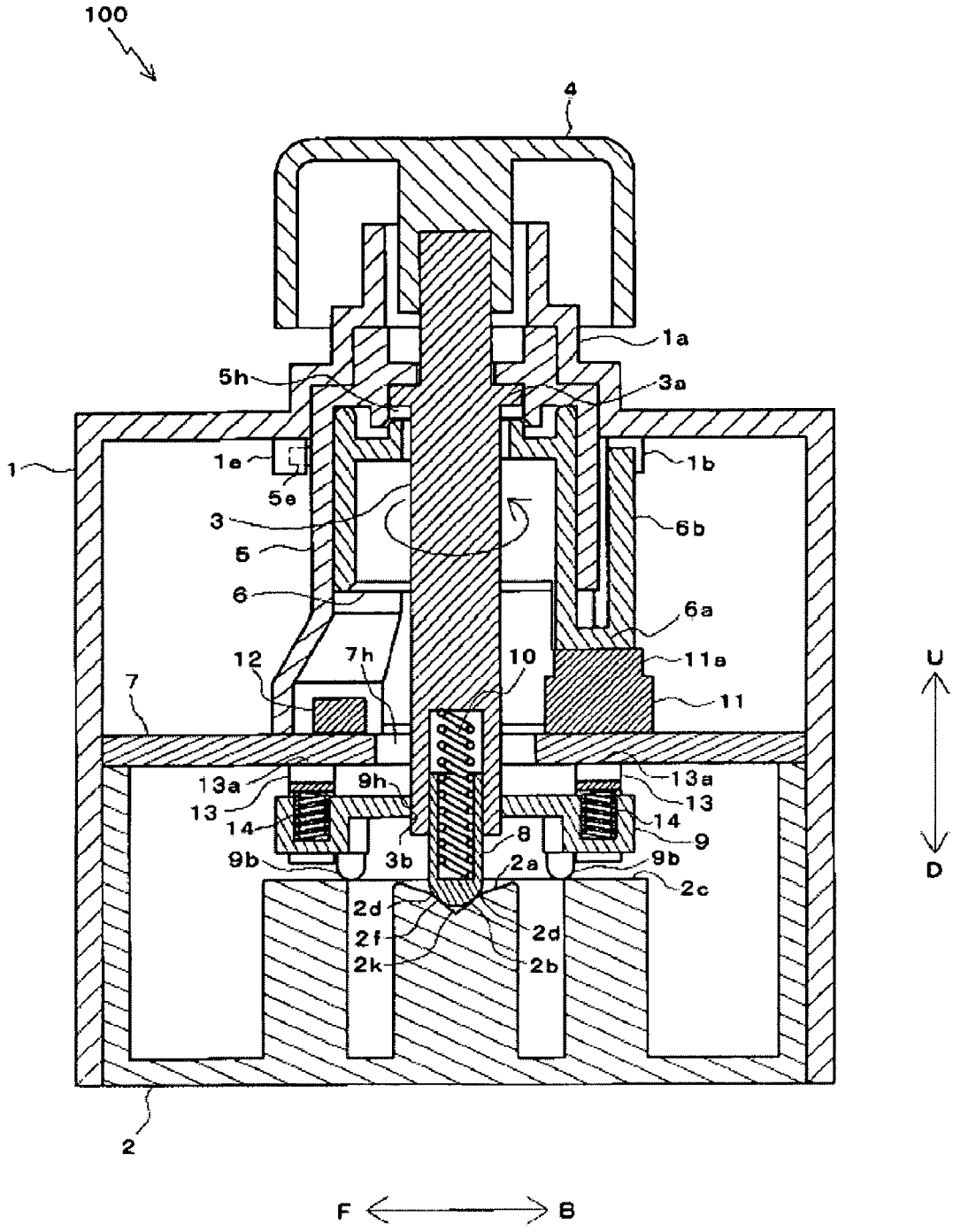
FIG. 7B shows a sectional view of the switching apparatus taken along the line Z—Z in FIG. 2.

As shown in FIGS. 7B and 8, the outer striker 5 is provided at its upper outer peripheral surface with a projection 5*e*. The outer striker 5 is provided with two stoppers 1*e* such that the stoppers 1*e* are integral with the case 1. The projection 5*e* abuts against the stoppers 1*e* when the outer striker 5 follows the operation shaft 3 and rotates in the clockwise direction P or counterclockwise direction Q through a predetermined angle (45°). If the projection 5*e* abuts against the stoppers 1*e*, the outer striker 5, the operation shaft 3 and the operation knob 4 are prevented from excessively rotating more than predetermined angles. Alternatively, the inner peripheral surface of the outer striker 5 or the outer peripheral surface of the operation shaft 3 may be provided with a projection instead of the projection 5*e* and the stoppers 1*e*, the substrate 7 may be provided with another projection which abuts against the projection when the outer striker 5 and the operation shaft 3 rotate through a predetermined angle, and the excessive rotation of the operation shaft 3 and the like may be limited.

As shown in FIGS. 3, 4 and 8, the outer striker 5 is provided with a lower outer peripheral surface with an engaging portion 5*a* comprising a projection having an arc tip end. Two guide walls 1*c* are provided on opposite sides of the engaging portion 5*a* such that the guide walls 1*c* are integrally formed with the case 1. The guide walls 1*c* engage with the engaging portion 5*a* to guide rotation of the outer striker 5 and movement of the engaging portion 5*a* when the operation shaft 3 is rotated. The guide walls 1*c* are warped in the opposite direction from the outer striker 5, the guide walls 1*c* are disposed on opposite sides of the engaging portion 5*a* in a V-form. A convex portion 1*d* and a recess 1*k* are formed in parallel to each other in the guide wall 1*c* in a direction in which the engaging portion 5*a* is guided (rotation direction of the outer striker 5). The outer striker 5 and the guide wall 1*c* are made of synthetic resin. As shown in FIGS. 8A and 8B, when the engaging portion 5*a* is not in contact with the convex portion 1*d*, the guide wall 1*c* is not elastically deformed almost at all, the engaging portion 5*a* and the guide wall 1*c* are engaged with each other under small pressure, and when the engaging portion 5*a* is in contact with the convex portion 1*d*, the guide wall 1*c* is elastically deformed and the engaging portion 5*a* and the guide wall 1*c* are engaged with each other under high pressure. Alternatively, the outer striker 5 may be provided with an elastic body such as a spring as the engaging portion, or the case 1 may be provided with an elastic body such as the spring so that the outer striker 5 and the case 1 are brought into engagement with each other with high reliable elastic force. The guide wall 1*c* constitutes an embodiment of the guide member of the present invention.

As shown in FIGS. 5, 10 and 7A, the slider 9 is provided below the substrate 7 (on the opposite side from the operation knob 4). Four legs 9*b* which are downwardly projecting bosses are formed on four corners of a lower surface of the slider 9. The legs 9*b* are supported on a support base 2*c* integrally provided on the cover 2. Two terminals 13 are mounted between the legs 9*b*. As shown in FIG. 10, the terminals 13 are provided such that they can vertically move through the slider 9. Two upwardly projecting movable contacts 13*a* are formed on an upper surface of each terminal 13. A coil spring 14 is interposed between the terminal 13 and the slider 9. The coil spring 14 upwardly biases the terminal 13, pushes the movable contact 13*a* against the lower surface of the substrate 7 under predetermined pressure, and biases the slider 9 downwardly, and pushes the legs 9*b* against the support base 2*c* under predetermined pressure. That is, the slider 9 and the terminal 13 are sandwiched between the substrate 7 and the support base 2*c*, and the movable contact 13*a* is always in contact with the lower surface of the substrate 7. The operation shaft 3 penetrates a hole 9*h* formed in a center of the slider 9. As shown in FIG. 1, a penetrating portion 3*b* of the operation shaft 3 which penetrates a hole 9*h* is of polygonal (octagonal) shape, the hole 9*h* is formed into polygonal (octagonal) shape having the same shape and substantially the same size as those of the penetrating portion 3*b*. Therefore, the slider 9 and the movable contact 13*a* of the terminal 13 can follow the operation shaft 3 and can rotate and can move in parallel to the substrate 7. The support base 2*c* has such a size that the movable contact 13*a* does not fall from the support base 2*c* when moving.

As shown in FIG. 6, a plurality of fixed contacts 7*pc*, 7*pr*, 7*pl*, 7*pu*, 7*pd*, 7*qc*, 7*qr*, 7*ql*, 7*qu*, 7*qd* are formed on the lower surface of the substrate 7. The fixed contacts 7*pc*, 7*pr*, 7*pl*, 7*pu*, 7*pd* output signals for tilting the right side mirror vertically and laterally to the control unit. The fixed contacts 7*qc*, 7*qr*, 7*ql*, 7*qu*, 7*qd* output signals for tilting the left side mirror vertically and laterally to the control unit. The slider 9 follows the operation shaft 3 and rotates. With this, the movable contact 13*a* of the terminal 13 moves to a position close to the fixed contacts 7*pc*, 7*pr*, 7*pl*, 7*pu*, 7*pd* or close to the fixed contacts 7*qc*, 7*qr*, 7*ql*, 7*qu*, 7*qd*. The slider 9 follows the operation shaft 3 and moves to one of forward, backward, leftward and rightward directions in parallel to the substrate 7. With this, the movable contact 13*a* comes into contact with the fixed contacts 7*pc*, 7*pr*, 7*pl*, 7*pu*, 7*pd*, 7*qc*, 7*qr*, 7*ql*, 7*qu*, 7*qd* located in the moving direction, the fixed contacts are switched from the OFF state to ON state. The fixed contacts 7*pc*, 7*pr*, 7*pl*, 7*pu*, 7*pd*, 7*qc*, 7*qr*, 7*ql*, 7*qu*, 7*qd* constitute one embodiment of second and third contacts of the present invention.

Electronic components (not shown) are also mounted on the lower surface of the substrate 7. An electric circuit comprising these electronic components and a wire pattern (not shown) is formed. Mounted on the switching apparatus 100 are connecting parts such as a connector and an electric wire (not shown) for outputting switching signals of the fixed contacts 7*pc*, 7*pr*, 7*pl*, 7*pu*, 7*pd*, 7*qc*, 7*qr*, 7*ql*, 7*qu*, 7*qd* and the inner contact of the push switch 11 to the control unit by mounting them on the substrate 7.

In the above structure, when the operation knob 4 is not operated, the various portions are in the initial state as shown in FIGS. 2, 3, 4A, 5, 6A, 7A, 8A and 9. If the operation knob 4 is once pushed downward D in FIG. 2 from this initial state, the operation shaft 3 downwardly moves as shown in FIG. 7D, and the flange 3*a* pushes the inner striker 6 downward. Thus, the actuator 11*a* of the push switch 11 is pushed by the pressing portion 6*a* of the inner striker 6, and the inner contact of the push switch 11 is switched from the OFF state to the ON state. At that time, drag of the actuator 11*a* with respect to the pressing portion 6*a* is abruptly varied (once increased and then reduced) by an internal mechanism of the push switch 11, and click feeling is provided through the inner striker 6, the operation shaft 3 and the operation knob 4. Thus, if a user operate the operation knob 4 by pushing the same while relying on the click feeling, the operation shaft 3 and the inner striker 6 can be moved to an appropriate position (to a position where the pressing portion 6*a* of the inner striker 6 moves the actuator 11*a* of the push switch 11 downward by a stroke required for switching the inner contact). If the inner contact of the push switch 11 is switched, the switching signal is output from the switching apparatus 100 to the control unit as a signal for tiling up the side mirror, and the control unit which received the signal drives an electric motor such as a motor, thereby tilting up the left and right side mirrors.

If the pushing operation of the operation knob 4 is released, the operation shaft 3 is biased upward by the coil spring 10, and the flange 3*a* stops pushing the inner striker 6. Therefore, the actuator 11*a* of the push switch 11 is biased upward by the internal mechanism, the pressing portion 6*a* of the inner striker 6 is pushed up, and the inner contact of the push switch 11 is switched from the ON state to the OFF state. As shown in FIGS. 7A and 9, the operation shaft 3, the operation knob 4 and the inner striker 6 returned to their original positions. Then, if the operation knob 4 is again pushed, the inner contact of the push switch 11 is switched from the OFF state to the ON state, and this switching signal is output from the switching apparatus 100 to the control unit as a signal for tilting down the side mirror, and the control unit which received the signal drives the electric motor to tilt down the left and right side mirrors.

Figure 6B:
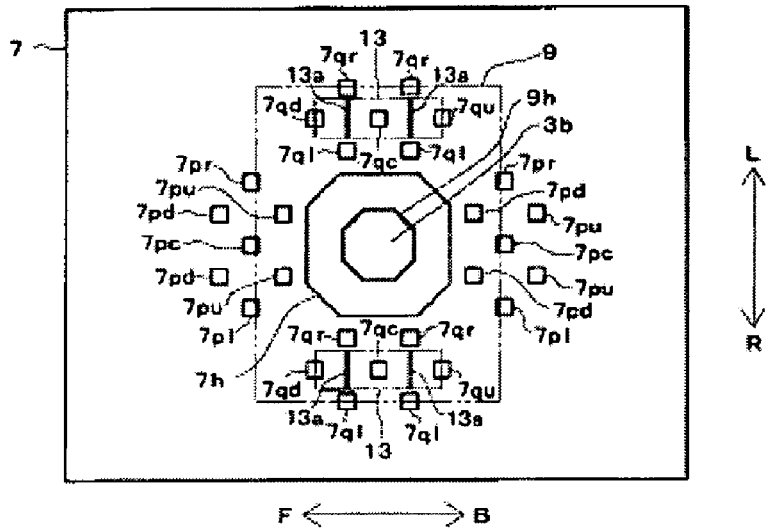

If the operation knob 4 is rotated in the counterclockwise direction Q shown in FIG. 2 from the initial state, the operation shaft 3 is rotated and the flange 3*a* rotates the outer striker 5 as shown in FIGS. 4B and 8B. At that time, the engaging portion 5*a* of the outer striker 5 climbs over the convex portion 1*d* from the recess 1*k* of the guide wall 1*c*. With this, the engagement force between the engaging portion 5*a* and the guide wall 1*c* is abruptly varied (once increased and then reduced), and the click feeling is provided through the outer striker 5, the operation shaft 3 and the operation knob 4. Therefore, if a user operate the operation knob 4 by rotating the same while relying on the click feeling, the operation shaft 3 and the outer striker 5 can be rotated to an appropriate position (to a position where the engaging portion 5*a* of the outer striker 5 rotates through 45° and climbs over the convex portion 1*d* of the guide wall 1*c*). The projection 5*e* abuts against the stoppers 1*e* as described above. With this, excessive rotation of the outer striker 5 beyond the appropriate position is limited. At the same time, the operation shaft 3 hitches the slider 9 with the penetrating portion 3*b*, and rotates the slider 9 and the terminal 13 in the counterclockwise direction Q through 45° as shown in FIGS. 6B and 7B. Therefore, the movable contact 13*a* of the terminal 13 moves to a position close to the fixed contacts 7*qc*, 7*qr*, 7*ql*, 7*qu*, 7*qd*, and the visual angle of the left side mirror can be adjusted (vertically and laterally tilted).

Figure 6C:
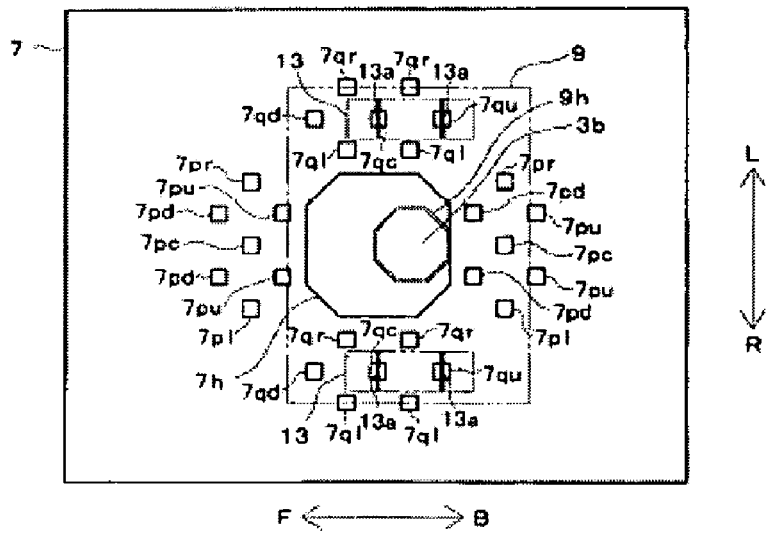
Figure 7C:
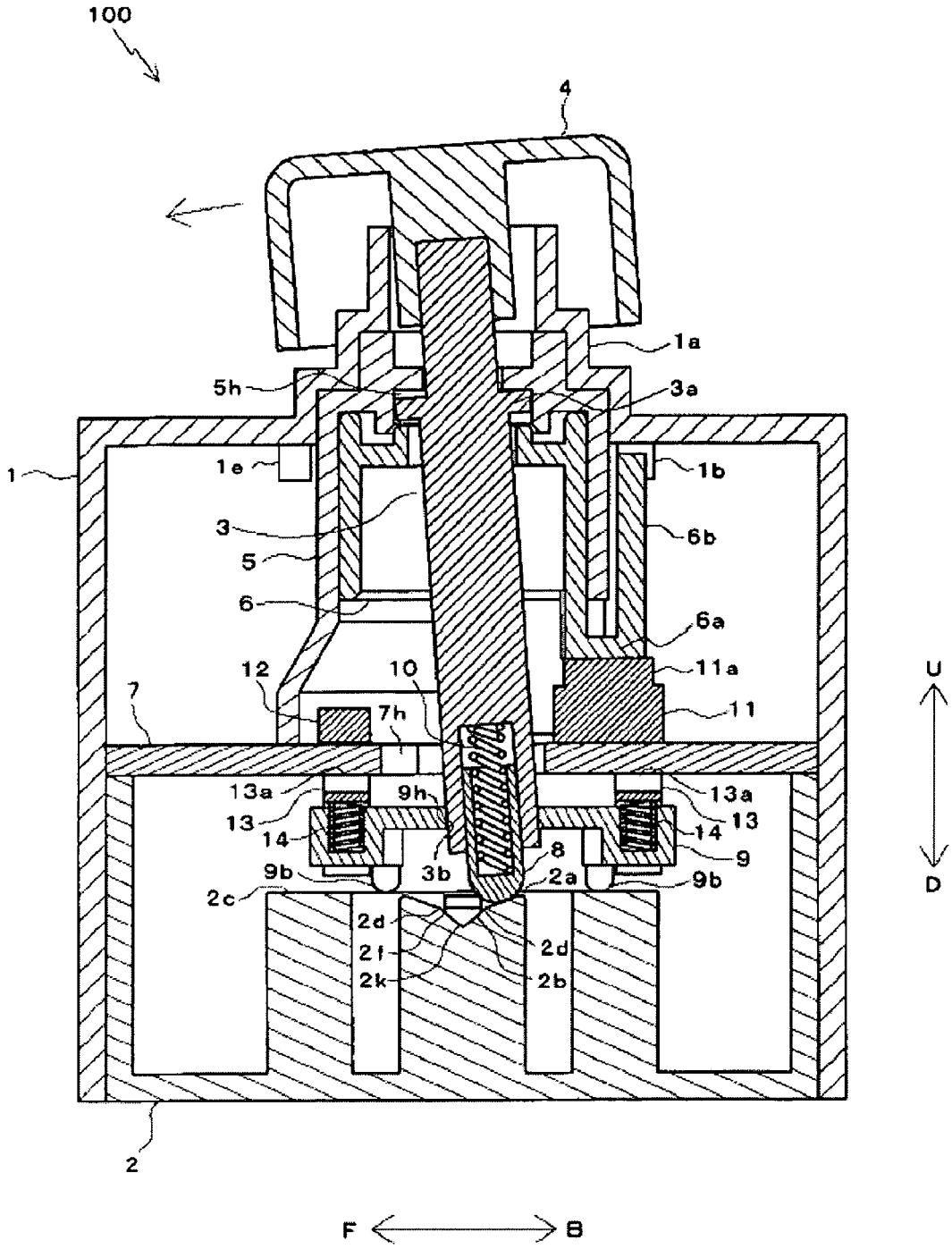
FIG. 7C shows a sectional view of the switching apparatus taken along the line Z—Z in FIG. 2.
Figure 7D:
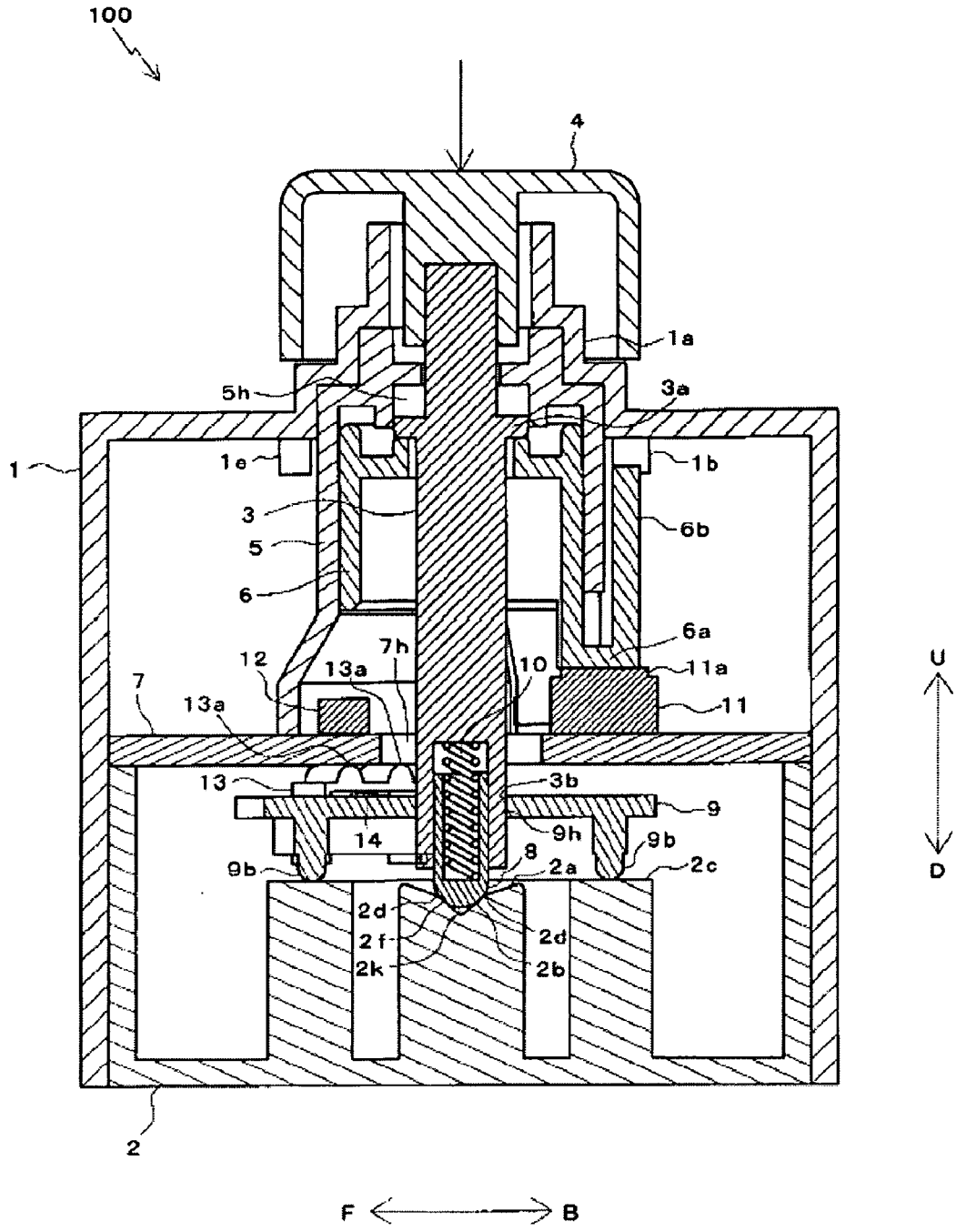
FIG. 7D shows a sectional view of the switching apparatus taken along the line Z—Z in FIG. 2.

If the operation knob 4 is rocked forward F from the rotation state, the operation shaft 3 is rocked as shown in FIG. 7C, and the plunger 8 is upwardly moved along the oblique surface 2*b* of the guide pedestal 2*a* in a direction B opposite from the operating direction F of the operation knob 4. At that time, the plunger 8 climbs over the convex portion 2*d* from the recess 2*k* of the guide pedestal 2*a* and with this, the engagement force between the plunger 8 and the guide pedestal 2*a* is abruptly varied (once increased and then reduced), and click feeling is provided through the plunger 8, the operation shaft 3 and the operation knob 4. Therefore, if a user operate the operation knob 4 by rocking the same while relying on the click feeling, the operation shaft 3 can be rocked to an appropriate position (to a position where the plunger 8 climbs over the convex portion 2*d* of the guide pedestal 2*a*). The flange 3*a* abuts against the upper and side surfaces of the space 5*h* of the outer striker 5. With this, excessive rotation of the operation shaft 3 beyond the appropriate position is limited. At the same time, the operation shaft 3 hitches the slider 9 with the penetrating portion 3*b*, and moves the slider 9 and the terminal 13 in the direction B opposite from the operating direction F of the operation knob 4 in parallel to the substrate 7 as shown in FIGS. 7C and 6C. Therefore, the two movable contacts 13*a* of the terminal 13 respectively come into contact with the two fixed contacts 7*qc* and 7*qu* located in the moving direction B, these fixed contacts 7*qc* and 7*qu* are connected to each other through the terminal 13, and the state is switched from the OFF state to the ON state. This switching signal is output from the switching apparatus 100 to the control unit as a signal for tilting up the left side mirror, and the control unit which received this signal drives the electric motor to tilt up the left side mirror through a predetermined angle.

If the rocking operation of the operation knob 4 is released, the plunger 8 is downwardly biased by the coil spring 10, the plunger 8 moves downward along the oblique surface 2*b* of the guide pedestal 2*a*, and the plunger 8 returns to its position before the plunger 8 is fitted in the recess 2*k* as shown in FIG. 7A. Further, the operation shaft 3 is biased upward by the coil spring 10, and pulled by the plunger 8 and rocked such as to be perpendicular to the substrate 7, and the operation shaft 3 returns to a position before the operation shaft 3 and the operation knob 4 rock as shown in FIG. 7A. At the same time, the slider 9 is pulled by the penetrating portion 3*b* of the operation shaft 3, and moves in parallel to the substrate 7, and returns to a position before the slider 9 and the terminal 13 rock as shown in FIGS. 7A and 6B. Therefore, the movable contact 13*a* of the terminal 13 comes to an intermediate position of the fixed contacts 7*qc*, 7*qr*, 7*ql*, 7*qu*, 7*qd*, and the movable contact 13*a* does not come into contact with any of the fixed contacts 7*qc*, 7*qr*, 7*ql*, 7*qu*, 7*qd*, and the fixed contacts 7*qc* and 7*qu* are opened, and the state is switched from the ON state to the OFF state.

If the operation knob 4 is rocked rearward B in FIG. 2 from the state shown in FIG. 6B the operation shaft 3 is rocked, the plunger 8 is moved along the oblique surface 2*f* (FIG. 7A and the like) of the guide pedestal 2*a* in the direction F opposite from the operating direction B, and the slider 9 is moved to the opposite direction F in parallel to the substrate 7. Therefore, the movable contacts 13*a* come into contact with the fixed contact 7*qd* and 7*qc*, respectively, and the fixed contacts 7*qd* and 7*qc* are switched from the OFF state to the ON state. If the operation knob 4 is rocked leftward L in FIG. 2, the operation shaft 3 is rocked, the plunger 8 is moved along the oblique surface 2*r* (FIG. 9) of the guide pedestal 2*a* in the opposite direction R, and the slider 9 is moved in the opposite direction R in parallel to the substrate 7. Therefore, the movable contacts 13*a* come into contact with fixed contact 7*ql*, and the fixed contact 7*ql* is switched from the OFF state to the ON state. If the operation knob 4 is rocked rightward R, the operation shaft 3 is rocked, the plunger 8 is moved along the oblique surface 21 (FIG. 9) of the guide pedestal 2*a* in the opposite direction L, and the slider 9 is moved in the opposite direction L in parallel to the substrate 7. Therefore, the movable contacts 13*a* come into contact with the fixed contact 7*qr*, and the fixed contact 7*qr* is switched from the OFF state to the ON state. These switching signals are output from the switching apparatus 100 to the control unit as signals for tilting the left side mirror downward, leftward or rightward, and the control unit which received the signal drives the electric motor, and tilts the left side mirror downward, leftward or rightward through a predetermined angle.

On the other hand, if the operation knob 4 is rotated in the clockwise direction P in FIG. 2 from the initial state, the operation shaft 3, the outer striker 5, the slider 9 and the like rotate in the clockwise direction P through 45°, the movable contact 13*a* moves to a position close to the fixed contacts 7*pc*, 7*pr*, 7*pl*, 7*pu*, 7*pd*, and it becomes possible to adjust the visual angle of the right side mirror. If the operation knob 4 is rocked forward F, rearward B, leftward L or rightward R from this rotation state, the operation shaft 3 is rocked in the operation direction in the same manner as that described above, and the plunger 8, the slider 9 and the terminal 13 are moved in the opposite direction. Therefore, the movable contact 13*a* comes into contact with the fixed contacts 7*pc*, 7*pr*, 7*pl*, 7*pu*, 7*pd*, and the fixed contacts are switched from the OFF state to the ON state. These switching signals are output from the switching apparatus 100 to the control unit as signals for tilting the right side mirror upward, downward, leftward or rightward, and the control unit which received the signal drives the electric motor, and tilts the right side mirror upward, downward, leftward or rightward through a predetermined angle.

If the operation knob 4 is pushed to move the operation shaft 3 downward, the inner striker 6 follows the operation shaft 3 and moves downward to push the actuator 11*a* of the push switch 11. Therefore, the inner contact of the push switch 11 can be switched from the OFF state to the ON state. If the operation knob 4 is rotated to rotate the operation shaft 3, the slider 9 follows the operation shaft 3 and rotates, and a contact with which the movable contact 13*a* on the slider 9 can come into contact can be switch to the fixed contacts 7*pc*, 7*pr*, 7*pl*, 7*pu*, 7*pd* or the fixed contacts 7*qc*, 7*qr*, 7*ql*, 7*qu*, 7*qd* of the substrate 7. If the operation knob 4 is rocked to rock the operation shaft 3, the slider 9 follows the operation shaft 3 and moves in parallel to the substrate 7, and the movable contact 13*a* comes into contact with any of the fixed contacts 7*pc*, 7*pr*, 7*pl*, 7*pu*, 7*pd*, 7*qc*, 7*qr*, 7*ql*, 7*qu*, 7*qd*. Therefore, the contacted fixed contact can be switched from the OFF state to the ON state. Therefore, different switching actions can be realized by pushing, rotating and rocking the one operation knob 4, and it is possible to remarkably enhance the operability as compared with the conventional switching apparatus provided with a plurality of operation knobs which are operated in the different manners.

Since the two strikers 5 and 6 support the operation shaft 3, the number of parts is small and the structure can be simplified as compared with the switching apparatus of Japanese Patent Application Laid-Open No. 2001-291456. The inner striker 6 is disposed inside of the outer striker 5, the push switch 11 is provided in the vicinity of the operation shaft 3 below the inner striker 6, and the inner contact of the push switch 11 is switched by the inner striker 6. Therefore, the space in the case 1 occupied by the strikers 5 and 6 and the inner contact of the push switch 11 can be reduced as compared with the switching apparatus of Japanese Patent Application Laid-Open No. 2001-291456, and the switching apparatus 100 can be reduced in size. Especially the switching apparatus 100 can largely be reduced in size in the width direction (forward F, backward B, leftward L and rightward R).

The notch 5*k* is provided in the lower end of the outer striker 5, and the push switch 11 is disposed in the notch 5*k*. Therefore, the outer striker 5 can be disposed near the inner striker 6 and the operation shaft 3 without hindering the push switch 11 (overlap or contact), and the switching apparatus 100 can further be reduced in size.

The guide wall 1*c* which guides rotation of the outer striker 5 which follows the operation shaft 3 is provided. Therefore, when the operation knob 4 is rotated, the engaging portion 5*a* of the outer striker 5 engages with the recess 1*k* and the convex portion 1*d* of the guide wall 1*c* and click feeling can be given. In addition, since the guide wall 1*c* is disposed near the outer side of the outer striker 5, the space in the case 1 occupied by the guide wall 1*c* can be reduced, the push switch 11 can be disposed closer to the operation shaft 3 than the guide wall 1*c* and the outer striker 5 which provide click feeling at the time of rotation operation without being hindered by the guide wall 1*c* and the outer striker 5, and the switching apparatus 100 can further be reduced in size.

The inner contact of the push switch 11 is employed as a contact which is switched by pushing the operation knob 4, and the push switch 11 is mounted on the upper surface of the substrate 7. Therefore, it is easier to dispose the contact and the number of parts required for switching the contact is smaller (two, i.e., the operation shaft 3 and the inner striker 6), and the structure of the switching apparatus 100 can further be simplified as compared with the switching apparatus as disclosed in Japanese Patent Application Laid-Open No. 2001-291456 in which the fixed contact and the movable contact are provided separately as contacts which are switched by pushing the operation knob.

Further, since the push switch 11 is provided, the click feeling can be exhibited when the operation knob 4 is pushed, and since the outer striker 5 and the guide wall 1*c* are provide, the click feeling can be exhibited when the operation knob 4 is rotated. Since the plunger 8, the coil spring 10 and the guide pedestal 2*a* are provided, the click feeling can be exhibited when the operation knob 4 is rocked. Therefore, the operation knob 4 can appropriately be pushed, rotated and rocked while relying on the click feeling, and the inner contact of the push switch 11 and the fixed contacts 7*pc*, 7*pr*, 7*pl*, 7*pu*, 7*pd*, 7*qc*, 7*qr*, 7*ql*, 7*qu*, 7*qd* of the substrate 7 can normally be switched, and the operability can further be enhanced. In addition, because the number of parts which exhibit the click feeling, the structure of the switching apparatus 100 can be simplified.

According to the above-described embodiment, the present invention is applied to the switching apparatus 100 used for the power mirror apparatus of the automobile, but the invention can also be applied to a switching apparatus used for a purpose other than the power mirror apparatus that can be operated by pushing, rotating and rocking.

What is claimed is:

1. A switching apparatus comprising a case, an operation shaft whose one end outwardly projects from inside of the case and which is provided at its central portion with a flange, a support member which supports the flange such that the operation shaft can rock and rotate, an operation knob mounted on one end of the operation shaft, a first contact which is switched when the operation knob is pushed to move the operation shaft, a second contact which is switched when the operation knob is rotated to rotate the operation shaft, and a third contact which is switched when the operation knob is rocked to rock the operation shaft, wherein the support member comprises a first support member which supports the flange from the operation knob in a state where the operation shaft penetrates the first support member, and a second support member which is disposed inside of the first support member and which supports the flange from the opposite side from the operation knob in a state where the operation shaft penetrates the second support member, the first contact is disposed in the vicinity of the operation shaft on the opposite side from the operation knob of the support member adjacent to the second support member, and the first contact is switched by the second support member which follows the operation shaft and moves when the operation knob is pushed.

2. A switching apparatus according to claim 1, wherein a notch is provided in the first support member on the opposite side from the operation knob, and the first contact is disposed in the notch.

3. A switching apparatus according to claim 2, wherein when the operation knob rotates, the first support member follows the operation shaft and rotates, a guide member is provided in the vicinity of an outer side of the first support member, the guide member engages with the first support member under predetermined pressure for guiding rotation of the first support member, a recess and a convex portion are provided in parallel to each other on the guide member in the rotation direction.

4. A switching apparatus according to claim 3, wherein the first contact is provided in a push switch having an actuator which can be pushed, the actuator is switched if the actuator is pushed by the support member.

5. A switching apparatus according to claim 2, wherein the first contact is provided in a push switch having an actuator which can be pushed, the actuator is switched if the actuator is pushed by the support member.

6. A switching apparatus according to claim 1, wherein when the operation knob rotates, the first support member follows the operation shaft and rotates, a guide member is provided in the vicinity of an outer side of the first support member, the guide member engages with the first support member under predetermined pressure for guiding rotation of the first support member, a recess and a convex portion are provided in parallel to each other on the guide member in the rotation direction.

7. A switching apparatus according to claim 6, wherein the first contact is provided in a push switch having an actuator which can be pushed, the actuator is switched if the actuator is pushed by the support member.

8. A switching apparatus according to claim 1, wherein the first contact is provided in a push switch having an actuator which can be pushed, the actuator is switched if the actuator is pushed by the support member.

* * * * *